US011976470B2

(12) United States Patent
Zorn

(10) Patent No.: US 11,976,470 B2
(45) Date of Patent: May 7, 2024

(54) HARD FLOOR PANEL FOR FLOATING INSTALLATION WITH THE FORMATION OF A FLOORING PANEL NETWORK

(71) Applicant: Flooring Technologies Ltd., Kalkara (MT)

(72) Inventor: Marcel Zorn, Perleberg (DE)

(73) Assignee: Flooring Technologies Ltd., Kalkara (MT)

( * ) Notice: Subject to any disclaimer, the term of this patent is extended or adjusted under 35 U.S.C. 154(b) by 100 days.

(21) Appl. No.: 17/436,133

(22) PCT Filed: Feb. 24, 2020

(86) PCT No.: PCT/EP2020/054767

§ 371 (c)(1),
(2) Date: Sep. 3, 2021

(87) PCT Pub. No.: WO2020/182453

PCT Pub. Date: Sep. 17, 2020

(65) Prior Publication Data

US 2022/0205253 A1 Jun. 30, 2022

(30) Foreign Application Priority Data

Mar. 12, 2019 (EP) ..... 19162167

(51) Int. Cl.
*E04F 15/00* (2006.01)
*E04F 15/02* (2006.01)
*E04F 15/10* (2006.01)

(52) U.S. Cl.
CPC ..... *E04F 15/02038* (2013.01); *E04F 15/102* (2013.01); *E04F 15/107* (2013.01); *E04F 2201/0161* (2013.01); *E04F 2201/043* (2013.01)

(58) Field of Classification Search
CPC ..... E04F 15/02033; E04F 15/02038; E04F 15/107; E04F 15/102; E04F 2201/042;
(Continued)

(56) References Cited

U.S. PATENT DOCUMENTS 6,209,278 B1 * 4/2001 Tychsen ..... F16B 5/008 52/592.4
6,766,622 B1 * 7/2004 Thiers ..... E04F 15/04 144/380

(Continued)

FOREIGN PATENT DOCUMENTS

CN 101529032 A 9/2009
CN 201762959 U 3/2011

(Continued)

*Primary Examiner* — Chi Q Nguyen
(74) *Attorney, Agent, or Firm* — The Webb Law Firm

(57) ABSTRACT

Provided is a hard floor panel having a top side and a bottom side and having side edges along the panel sides for floating installation to form a floor panel composite. At least two floor panels are joined together in each case, the opposite side edges being provided with tongue-and-groove profiles, a tongue and a joining surface is provided in a first side edge and a groove and a joining surface is provided in a second opposite side edge. The tongue of the first side edge has an upper side and a lower side. A projection with a contact surface is provided on the lower side of the tongue. The joining surface of the first side edge extends from the upper side of the floor panel towards the upper tongue side and the joining surface is beveled.

15 Claims, 6 Drawing Sheets

(58) Field of Classification Search
CPC ..... E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138; E04F 2201/0161
See application file for complete search history.

(56) References Cited

U.S. PATENT DOCUMENTS

| | | | | |
|---|---|---|---|---|
| 8,839,584 | B2 | 9/2014 | Sokol | |
| 9,695,600 | B2 * | 7/2017 | Vandevoorde | B32B 29/06 |
| 9,885,187 | B2 * | 2/2018 | Kell | E04F 15/02033 |
| 10,156,078 | B2 | 12/2018 | Palsson et al. | |
| 10,428,535 | B2 | 10/2019 | Van Hooydonck | |
| 10,704,269 | B2 | 7/2020 | Whispell et al. | |
| 10,808,410 | B2 * | 10/2020 | Boo | E04F 15/02038 |
| 11,359,384 | B2 * | 6/2022 | Markovski | E04F 15/10 |
| 2003/0024200 | A1 | 2/2003 | Moriau et al. | |
| 2004/0031225 | A1 * | 2/2004 | Fowler | E04F 15/02 52/592.1 |
| 2004/0255541 | A1 * | 12/2004 | Thiers | E04F 15/02011 52/506.01 |
| 2005/0016107 | A1 | 1/2005 | Rosenthal et al. | |
| 2005/0028474 | A1 * | 2/2005 | Kim | E04F 15/04 52/578 |
| 2006/0064940 | A1 | 3/2006 | Cappelle | |
| 2008/0000182 | A1 | 1/2008 | Pervan | |
| 2010/0018149 | A1 | 1/2010 | Thiers | |
| 2011/0173914 | A1 * | 7/2011 | Engstrom | E04F 15/02038 52/582.2 |
| 2012/0017534 | A1 | 1/2012 | Oh | |
| 2012/0266555 | A1 * | 10/2012 | Cappelle | B32B 3/06 52/309.1 |
| 2018/0010342 | A1 * | 1/2018 | Van Hooydonck | E04F 15/105 |
| 2019/0136545 | A1 * | 5/2019 | De Rick | E04F 15/107 |

FOREIGN PATENT DOCUMENTS

| | | | |
|---|---|---|---|
| CN | 106121176 | A | 11/2016 |
| CN | 108643512 | A | 10/2018 |
| DE | 102007043308 | B4 | 12/2009 |
| DE | 202018101660 | U1 | 5/2018 |
| EP | 1084317 | B1 | 4/2003 |
| EP | 1026341 | B1 | 8/2003 |
| EP | 1276941 | B1 | 1/2009 |
| EP | 1978179 | B1 | 4/2011 |
| JP | S59179937 | U | 12/1984 |
| JP | 2007154419 | A | 6/2007 |
| JP | 2008514830 | A | 5/2008 |
| WO | 2010114236 | A2 | 10/2010 |
| WO | 2011085306 | A1 | 7/2011 |
| WO | 2016113706 | A1 | 7/2016 |

* cited by examiner

HARD FLOOR PANEL FOR FLOATING INSTALLATION WITH THE FORMATION OF A FLOORING PANEL NETWORK

CROSS-REFERENCE TO RELATED APPLICATIONS

This application is the United States national phase of International Application No. PCT/EP2020/054767 filed Feb. 24, 2020, and claims priority to European Patent Application No. 19162167.1 filed Mar. 12, 2019, the disclosures of which are hereby incorporated by reference in their entirety.

BACKGROUND OF THE INVENTION

Field of the Invention

The disclosure relates to a hard floor panel for floating installation to form a flooring panel network, in particular a laminate floor.

Description of Related Art

Flooring panels with tongue-and-groove profiles on the side edges for installation to panel networks, such as laminate flooring, are widely and conventionally known. The tongue-and-groove profiles allow easy installation of floor panels to floor coverings. Such floor coverings can be, for example, fiberboard or plastic panels. Most often, the floor panels are covered with a decorative layer and an abrasion-resistant surface layer.

However, the conventionally used tongue-and-groove profiles have the disadvantage that gaps of different sizes are formed between the adjacent panels. Dirt as well as moisture can penetrate into these gaps and lead to an expansion or swelling of the floor panel's carrier board, especially in case of using wood-based material boards as carrier boards. The expansion or swelling of the wood-based material carrier panel causes the surface layer to lift, so that the surface layer is exposed to increased abrasion.

Different devices to join the floor panels during installation can reduce or prevent such gaps. However, the use of appropriate devices complicates the application of the floor panels and is therefore not advantageous.

Accordingly, various alternative tongue and groove profiles have been developed in the past to reduce the gap size.

For example, a floor panel for realizing a floor covering is known from EP 1026341 B1, wherein coupling parts in the form of a tongue and groove are provided at the edges of two opposite sides of the panels. In this case, the tongue and groove are designed in such a way that, when two or more floor panels are joined together, a clamping force is exerted on one another, which forces the floor panels together. The clamping force is caused by an elastically bendable lip in the groove, which is at least partially bent in the assembled state and thus provides the aforementioned clamping force.

However, even this approach causes a gap on the upper side of the joined panels, and here especially at the contact points of the joining surfaces of the two opposite side edges of two joined floor panels, through which moisture and dirt can penetrate between the floor panels.

SUMMARY OF THE INVENTION

Accordingly, it was the object of the proposed solution to further develop the tongue-and-groove profiles known from the prior art in such a way that gap formation at the joint surfaces of the floor panels is avoided, so as to prevent the penetration of moisture and dirt and the associated disadvantages.

This object is solved with a floor panel having features as described herein.

Accordingly, a flooring panel, in particular having a core of a wood-based material board, a wood-based material-plastic board or a plastic board, having a top side and a bottom side and having side edges along the panel sides (i.e. along the longitudinal sides and transverse sides) is provided for floating installation to form a flooring panel network,

- wherein at least two floor panels are joined or connected to each other in each case,
- wherein the opposite side edges are provided with tongue-and-groove profiling,
- wherein a tongue and a joining surface are provided in a first side edge and a groove and a joining surface are provided in a second opposite side edge,
- wherein the tongue of the first side edge has an upper side and a lower side;
- wherein a projection with a contact surface is provided on the lower side of the tongue;
- wherein the joining surface of the first side edge extends from the top of the floor panel toward the upper tongue side and the joining surface is beveled; wherein the joining surface of the first side edge is inclined away from the upper side of the floor panel inwardly away from the vertical towards the tongue;
- wherein the groove in the second side edge has an upper side and a lower side,
- wherein the upper side of the groove is defined by an upper lip and the lower side of the groove is defined by a lower lip;
- wherein a recess with a contact surface is provided in the lower lip of the groove;
- wherein the joining surface of the second side edge extends from the upper side of the floor panel along the upper lip of the groove and the joining surface is beveled; wherein the joining surface of the second side edge is inclined away from the upper side of the floor panel inwardly away from the vertical towards the groove,
- wherein, in the assembled state of at least two floor panels, the projection of the tongue engages the recess of the lower lip of the groove so that the contact surfaces of the projection of the tongue and the recess of the lower lip of the groove exert a tensioning force on each other; and
- wherein, when the beveled joining surface of the first side edge of the tongue profiling and the beveled joining surface of the second side edge of the groove profiling are in contact in the joined state of at least two floor panels, a line pressure occurs along the beveled joining surfaces of the side edges of the tongue profiling and the groove profiling at the contact points.

For the purposes of the proposed solution, joining surfaces means the pair of surfaces on which the joined panels bear against each other to form a flat upper surface of the joined and interlocked panels that is as closed as possible. Accordingly, the technical term joining surface includes the section of the side edges that are actually pressed together. The joining surfaces lie directly against each other to close the surface.

The combination of clamping force and line pressure according to the solution now makes it possible to avoid the formation of gaps between adjacent floor panels, thus reducing the ingress of moisture and dirt into the floor covering. The line pressure results from the profile geometry and the pressure to be applied.

In the present context, the term "line pressure" is to be understood as pressure, which runs in a line or essentially in a line along the joining or interlocking surfaces. In this case, the joining surfaces press against each other (along the entire or almost entire surface) in a practically linear manner.

The tongue and groove preferably have shapes that are complementary to each other. The projection on the lower side of the tongue extends along the lower lip of the groove and engages the recess of the lower lip of the groove in the coupled state of two panels. The contact surfaces of the projection of the tongue and the recess are in contact with each other. The tongue, in the coupled state of the floor panels, precisely abuts against the upper side and the lower side of the groove, exerting a pressure P on the upper lip of the groove. This pressure is not only absorbed by the upper lip, but by the complete structure, as the pressure can be transmitted through the tongue and the lower lip. The pressing pressure P causes the tensioning force by which the panels are assembled and held.

As explained above, when the beveled joining surface of the tongue profile edge and the beveled joining surface of the upper lip of the groove profile edge are in contact, a line pressure occurs, which prevents moisture penetration.

For the purposes of the solution, chamfering of the joining surfaces or joining edges means a chamfering or inclination of the joining surfaces or joining edges from the upper side of the panel inwards away from the vertical away from the tongue or towards the groove.

Usually, the panel top and the respective joining surface of the side edges form a right angle (90°); i.e., the panel top and the joining surface are arranged at right angles to each other. In the present case, the angle between the panel top and the joining surface is no longer right-angled, but forms an (acute) angle of between 85° and 89°, preferably between 87° and 89°, particularly preferably 88° and 89°.

In other words, the joining surfaces are each inclined away from the vertical (to the top of the panel) by an angle of between 1 and 5°, preferably between 1 and 3°, particularly preferably 2 and 3°.

Accordingly, in one embodiment of the present panel, the slope or inclination of the joining surface of the first side edge of the tongue profiling away from the top of the floor panel is between 1 and 5°, preferably between 1 and 3°, more preferably between 1 and 2°.

In another embodiment of the present panel, the slope or inclination of the joining surface of the second side edge of the groove profiling from the top of the floor panel along the upper lip to the groove is between 1 and 5°, preferably between 1 and 3°, more preferably between 1 and 2°.

In a preferred embodiment, the bevel or inclination of the joining surfaces of the tongue profiling and the groove profiling each have the same angle. Thus, the joining surface of the tongue profiling can be beveled by 1° and the joining surface of the groove profiling can also be beveled by 1°.

However, it is also possible for the bevel or inclination of the joining surfaces of the tongue profiling and the groove profiling to have different angles. For example, the joining surface of the tongue profiling can be beveled by 1° and the joining surface of the groove profiling can be beveled by 2°.

It is also possible that in a variant the joining surface of the tongue profiling has no bevel or inclination (i.e. running at right angles to the upper side of the floor panel) and second joining surface of the groove profiling has a bevel or inclination.

The reverse case is also possible. In such a variant, the first joining surface of the tongue profiling would have a bevel and the second joining surface of the groove profiling would not have a bevel (i.e. running at right angles to the upper side of the floor panel).

When the beveled joining surface of the tongue profiling and the beveled joining surface of the groove profiling are in contact in the joined state of two floor panels, a line pressure occurs at the contact point of the joining surfaces. Due to the bevel of the joining surfaces, starting from the (upper) contact point as the apex, an angle is formed between the opposing joining surfaces, the size of which depends on the angular sizes of the beveled joining surfaces and lies between 2 and 10°,preferably between 2 and 6°, preferably between 2 and 3°. Thus, in the case of a bevel of the joining surface of the tongue profiling of 1° and a bevel of the joining surface of the groove profiling of 1°, the angle between the opposing joining surfaces can be 2° in total. In the case of a bevel of the joining surface of the tongue profiling of 1° and a bevel of the joining surface of the groove profiling of 2°,the angle between the opposing joining surfaces is 3° in total.

The design of tongue profiling and groove profiling is described in more detail below.

The profiles with tongue and groove provided in the present floor panel as coupling parts between two panels are preferably formed in one piece.

As noted above, a tongue having an upper side and a lower side is provided in a first side edge. The distance of the top of the tongue from the top of the panel and the bottom of the tongue from the bottom of the panel may vary depending on the thickness of the panel.

The thickness of the tongue is preferably equal to the width of the groove, so that the upper lip of the groove is supported by the tongue, and the tongue is in turn supported by the lower lip of the groove.

The upper side of the tongue is flat and horizontal in relation to the upper side of the panel. The upper side of the tongue (or lower side of the upper lip of the tongue) is also flat and horizontal so that the tongue and tongue can engage or slide into each other without resistance. The upper side of the tongue and the lower side of the upper lip form contact surfaces that are substantially parallel to the plane defined by the floor panel.

In another embodiment of the present flooring panel, a recess is provided between the joining surface of the tongue profiling and the top surface of the tongue.

It is also envisaged that the lower side of the tongue has a bevel at its edge. This bevel can also be described as a chamfer with an angle between 45-55°.

As described above, the projection provided on the lower side of the tongue extends along the lower lip of the groove. The projection engages the recess of the lower lip of the groove in the coupled state of two panels. The angle of the contact surfaces of the projection of the tongue and the recess of the lower lip is between 30 and 70° with respect to the horizontal plane. This angle is ideal to achieve optimal pressing of the floor panels together and at the same time to allow easy engagement and assembly of the floor panels.

In the joined or coupled state of tongue and groove, an additional space can be formed between the projection of the lower tongue side and the recess in the lower lip of the groove, which functions, for example, as a dust chamber. The size of the dust chamber can vary, for example, between the profiles in the panel longitudinal sides (longitudinal profile) and panel transverse sides (transverse profile).

It is also envisaged that the lower lip of the groove extends beyond the upper lip of the groove. In this case, the recess in the lower lip of the groove is located in the section of the lower lip that extends beyond the upper lip of the groove.

In one embodiment of the present flooring panel, at least one saddle is provided in the recess of the lower lip of the groove. This saddle may be of different thickness in the transverse profile and longitudinal profile.

The thickness of the upper lip of the groove can be greater than or equal to the thickness of the lower lip. In the case of different thicknesses of the upper and lower lip, the center line through the tongue and groove is located below the center line of the panel. In this arrangement, the bottom lip of the groove is bent when two floor panels are joined, so that the top of the floor panel is not subjected to changes or deformation.

Also, upper and lower lips have rounded edges, which simplifies the joining of the panels. For example, the joining surface of the upper lip may have a rounded edge or chamfer. The chamfer is provided at the point of contact of the upper lip of the groove with the top of the tongue and allows for easy joining of the floor panels.

In another embodiment, a slope surface or chamfer (or ramp surface) is also provided at the free end of the lower lip of the groove, allowing the tongue-and-groove profiles to be easily slid into one another.

At the transition from the tongue and groove profiling to the underside of the panel, a chamfer or bevel is provided over a length of 0.6 mm with an angle of between 20 and 30°, preferably 25°. The chamfer is provided in particular in a counter-drawing arranged on the underside of the panel and enables better laying without splintering.

In further embodiments of the present floor panel, it is provided that the tongue-and-groove profilings have any of the following features or a combination thereof: Curves at the corners (or edges) of the tongue and groove profilings; dust chambers between all sides of the interlocking floor panels; in particular, the aforementioned dust chamber between the recess of the lower lip of the groove and the projection of the tongue;

The tongue and groove profiles allow two floor panels to engage with each other while applying a rotating or pivoting movement ("Angle-Angle"). First, a first floor panel is attached at an angle to a horizontally arranged second floor panel, followed by pivoting of the first floor panel in the direction of the installation plane so that the joined floor panels lie in the installation plane. To enable the two floor panels to engage with each other with a turning movement, the edges or curvatures are preferably rounded or circular.

The present flooring panel preferably has a rectangular shape, with tongue-and-groove profiling provided on the longitudinal side edges and on the transverse side edges, respectively.

The longitudinal profile used for connecting the panels along the longitudinal side edges may have the same or different tongue and groove profiling than the transverse profile used for connecting the panels along the transverse side edges.

Major differences between the longitudinal profile and the transverse profile concern the formation of a saddle in the recess of the lower lip, which also causes a larger space or chamber between the tongue projection and the groove recess in the assembled state of the floor panels. Also, in the case of the transverse profile, the lower lip of the groove has a ramp surface at the groove end, which is not provided in the longitudinal profile.

Preferably, the present panels have a core made of a wood-based panel, preferably an HDF or MDF panel, of a wood-based plastic panel, preferably a WPC panel, or of a plastic carrier panel, preferably a PVC carrier panel. In the case of the use of plastic, the core may have at least one filler in an amount of up to 70% of the total weight of the core of the carrier board, preferably using calcium carbonate or materials with comparable properties.

The thickness of the panels can be between 4 and 16 mm, preferably between 4.5 and 12 mm. Preferred panel thicknesses are 4.5 mm and 12 mm.

As indicated above, the present floor panels are used for floating installation of floor panels. A corresponding installation procedure comprises the following steps:

Laying of a first floor panel, and

Joining a second floor panel to the first floor panel, wherein the tongue of the second floor panel is inserted into the groove of the first floor panel, the lower lip of the groove profiling being bent outwardly in the joined state so that the lower lip provides a force by which the panels are permanently forced towards each other.

The pretension caused by the interaction of tongue and groove is optimally transferred to the upper side of the floor panel, whereby the joining surfaces of the tongue and groove profiles are pressed against each other in the direction of engagement in such a way that a line pressure occurs at the contact point of the joining surfaces, forming an angle between the joining surfaces.

BRIEF DESCRIPTION OF THE DRAWINGS

The solution is explained in detail below by means of the figures with reference to the following embodiments.

DESCRIPTION OF THE INVENTION

The solution is explained for rectangular floor panels, which can be joined together both at their longitudinal sides and at their transverse sides, or only at one side.

Figure 1A:
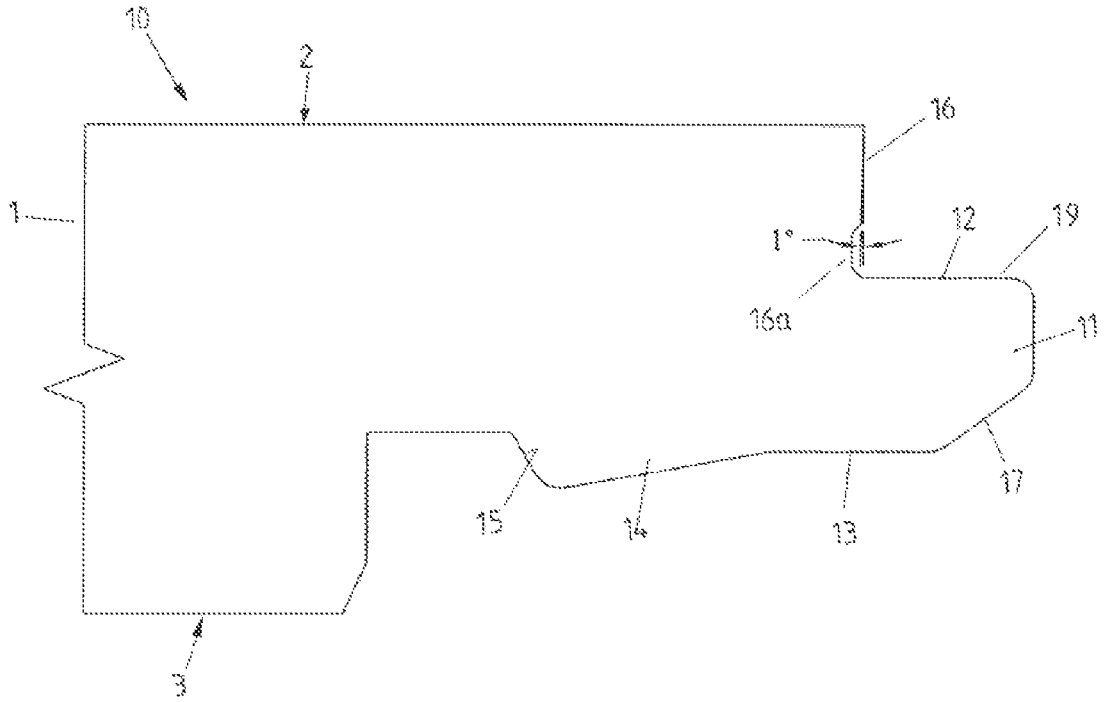
FIG. 1A shows a schematic cross-section of a floor panel with a thickness of 4.5 mm with a tongue profiling according to a first embodiment (transverse profile)
Figure 1B:
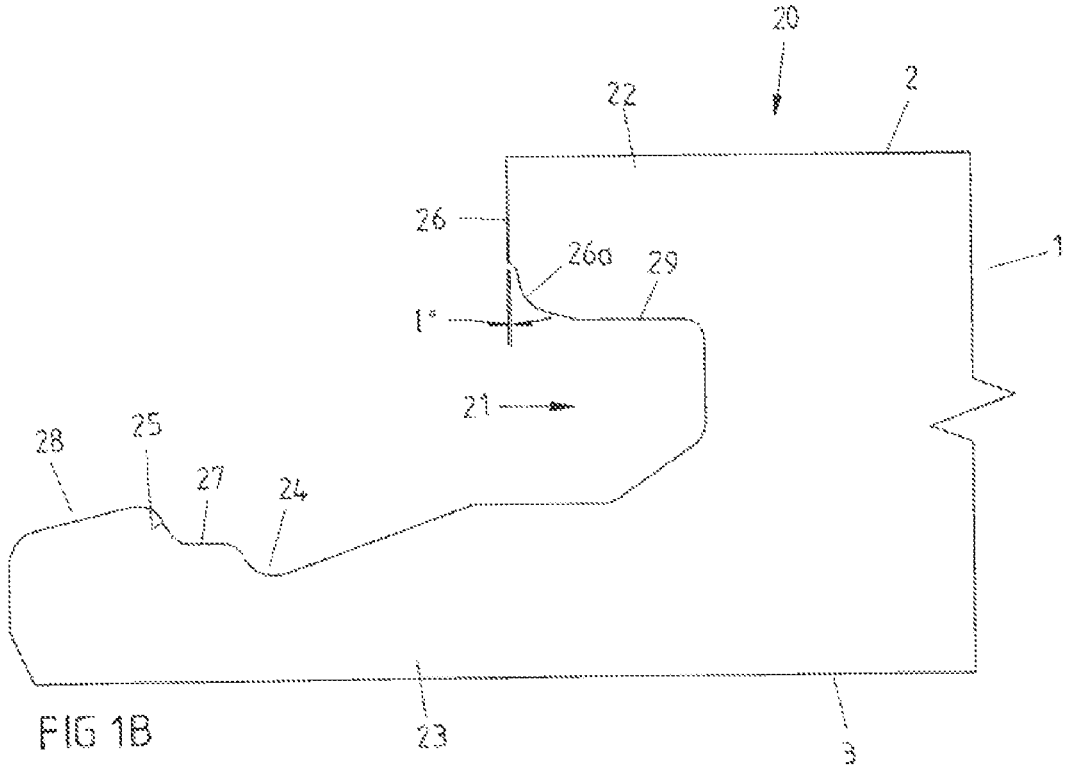
FIG. 1B shows a schematic cross-section of a floor panel with a thickness of 4.5 mm with a groove profiling according to a first embodiment (transverse profile)
Figure 2A:
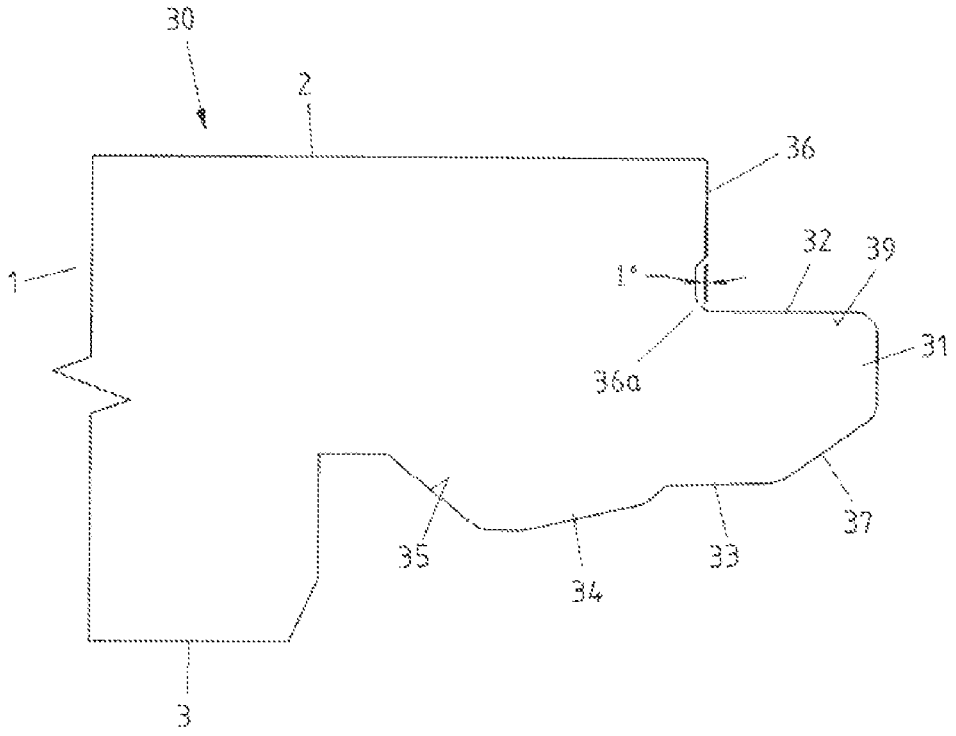
FIG. 2A shows a schematic cross-section of a floor panel with a thickness of 4.5 mm with a tongue profiling according to a second embodiment (longitudinal profile)
Figure 2B:
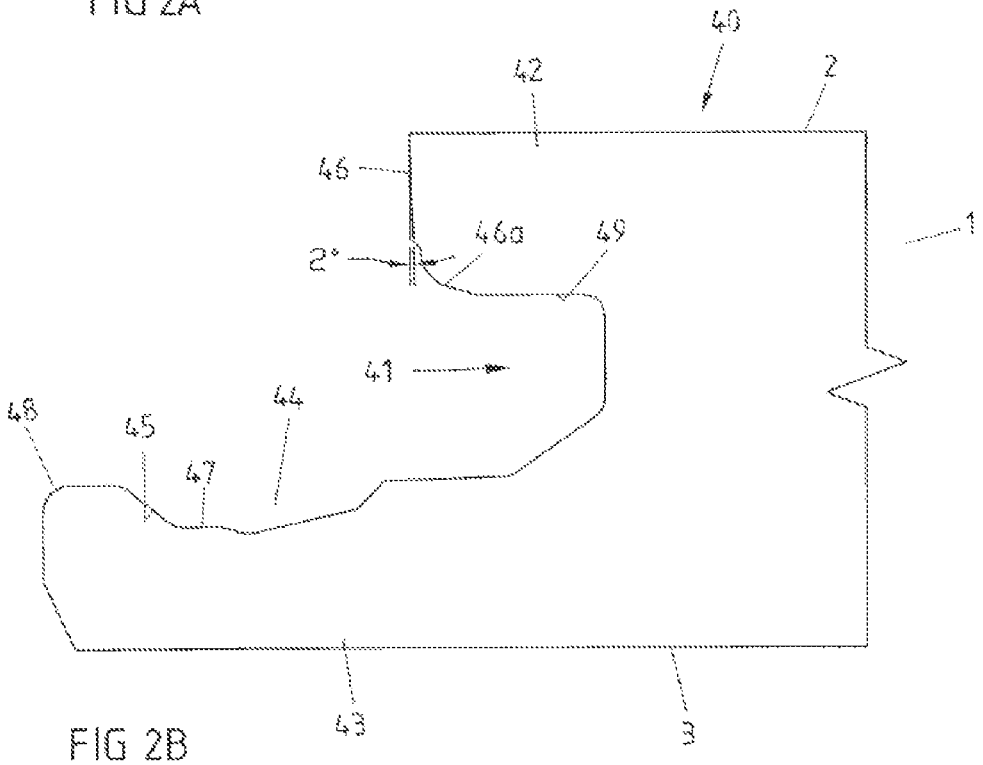
FIG. 2B shows a schematic cross-section of a floor panel with a thickness of 4.5 mm with a groove profiling according to a second embodiment (longitudinal profile)

Thus, the tongue profiling shown in FIG. 1A and the groove profiling shown in FIG. 1B are provided in the transverse sides of the floor panels, i.e. in the shorter sides, according to the first embodiment, while the profiling shown in FIGS. 2A and 2B is inserted in the longitudinal sides of the floor panels according to the second embodiment.

The present floor panels have a rectangular shape with side edges 10, 20 extending along the longitudinal sides and transverse sides of the panel and are suitable for floating installation forming a floor panel.

The floor panels typically have a length of one to 2 m. The thickness of the panels can also vary, but is 4.5 mm in the embodiments described in FIGS. 1A-C and 2A-C.

Each floor panel has tongue-and-groove profiling on the opposite edges 10, 20, as described in detail below, which enables 2 adjacent floor panels to be joined together. Here, a tongue 11 is provided in a first side edge 10 and a groove 21 is provided in the second opposite side edge 20.

FIG. 1A shows a first tongue profile provided for a transverse side of the floor panel. The tongue 11 of the tongue profile of the first side edge 10 has an upper side 12 and a lower side 13.

The distance of the upper side of the tongue 12 from the upper side of the panel or panel surface 2 and the distance of the lower side of the tongue 13 from the lower side of the panel 3 can vary depending on the panel thickness.

The top side 12 of the tongue 11 has a planar surface 19 that is horizontally disposed with respect to the panel top side. The length of the upper side of the tongue may be the same in the transverse profile (FIG. 1A) and longitudinal profile (FIG. 2A), while the length of the lower side of the tongue in the transverse profile is greater than the length of the lower side of the tongue in the longitudinal profile.

The lower side of the tongue 11 has a bevel or chamfer 17 at its edge with an angle between 45-55°.

The projection 14 with a contact surface 15 is provided on the lower side 13 of the tongue. The projection 14 has an inclination between 10° (transverse profile) and 44° (longitudinal profile) with respect to the flat, horizontal section of the bottom side 13 of the tongue.

The length and height of the projection 14 also vary depending on the design of the tongue as a transverse profile or longitudinal profile.

The tongue profile of FIG. 1A has a joining surface 16 at the side edge, which extends from the upper side 2 of the floor panel towards the upper tongue side 12 and has a bevel or slope from the upper side of the floor panel towards the upper tongue side. The bevel of the joining surface 16 extends at an angle of 1° with respect to the perpendicular to the upper side of the flooring panel. Thus, the joining surface 16 has an inward slope away from the perpendicular.

A recess 16*a* is provided at the transition of the joining surface 16 of the tongue profiling to the upper side 12 of the tongue.

The groove 21 provided in the second side edge 20 of the floor panel 1 according to the illustration of FIG. 1B has an upper side and a lower side, the upper side of the groove 21 being defined by an upper lip 22 and the lower side of the groove being defined by a lower lip 23. The width or width of the groove formed by the upper lip 22 and the lower lip 23 corresponds to the thickness of the tongue 11, so that the tongue 11 can be inserted into the groove 21.

The lower side of the upper lip 23 of the tongue with surface 29, like surface 19 of the upper side of the tongue, is flat and horizontally arranged so that the tongue and tongue can engage or slide into each other without resistance. Surface 19 of the top of the tongue and surface 29 of the bottom of the top lip 23 form contact surfaces that are substantially parallel to the plane defined by the floor panel.

The thickness of the upper lip 22 and the lower lip 23 differ, and the upper lip 22 can be thicker than the lower lip 23. Due to a smaller thickness of the lower lip 23, it serves as an elastically bendable projection.

A recess 24 with a contact surface 25 is provided in the lower lip 23 of the groove, recess 24 cooperating with contact surface 25 in a complementary manner to tongue 11 with contact surface 15. A saddle 27 is formed in recess 24. The formation of the saddle 27 in the transverse profile (FIG. 1B) and the saddle 47 longitudinal profile (FIG. 2B) is differently pronounced, which is due to the technical profile geometry and the associated pretensioning effect.

The groove profiling of FIG. 1B has a joining surface 26 at the side edge running along the upper lip 22. The joining surface 26 is beveled 13 like the joining surface 16 of the tongue 13 whereby here, too, the bevel of the joining surface 26 runs at an angle of 1° with respect to the perpendicular to the upper side of the panel.

A chamfer or bevel 26*a* is provided at the junction of the mating surface 26 to the underside of the upper lip 23 with the surface 29.

A ramp surface 28 is provided at the free end of the lower lip 23 of the groove to facilitate interlocking of the short transverse sides. The corresponding ramp surface 48 in the longitudinal profile (FIG. 2B), on the other hand, is less strongly formed, and is rather provided as a rounding. This geometric difference is due to the different behavior of the transverse profile and the longitudinal profile when the profiles are angled in during installation. The ramp area 28 allows easier placement of the transverse profiles. It also ensures that the profiles can be laid with impact wood without damage.

In the assembled state (see FIG. 1C), the projection 14 of the tongue 11 engages the recess 24 of the lower lip 23 of the groove so that the contact surface 15 of the projection 14 and the contact surface 25 of the recess 24 of the lower lip exert a clamping force or preload on each other.

When the beveled joining surface 16 of the tongue profiling and the beveled joining surface 26 of the groove profiling are in contact in the joined state of two floor panels, a line pressure occurs along the beveled joining surfaces 16, 26 at the contact of the joining surfaces 16, 26. An angle of 2° is formed between the beveled joining surfaces 16, 26. The upper contact points of the joining surfaces 16, 26 are thus pressed together to form an almost continuous surface.

Due to the geometric design of the tongue and groove profiles, dust chambers are formed between all sides of the interlocking floor panels. Particular reference should be made to the chamber shown in the transverse profile between the recess 24 of the lower lip 23 of the groove 20 and the projection 14 of the tongue 11 (FIG. 1C).

In the longitudinal profile (see FIG. 2C), however, this hollow space or dust chamber between recess 44 and projection 34 is smaller. This is due to the selected tongue mechanism of the groove profiles in the transverse profile and longitudinal profile, whereby the deflection is greater in the transverse profile than in the longitudinal profile. In addition, the transverse profile also has a higher profile spacing compared to the longitudinal profile (i.e. lower lip 23 of the transverse profile is longer than lower lip 43 of the longitudinal profile. This allows the grooved cheek of the transverse profile to tongue out, which, in combination with the ramp surface 28 and the cavity, makes it easier to install in the transverse profile. The slightly varying profile mass and geometry of the transverse profile and longitudinal profile is due in particular to the different behavior of the transverse profile and longitudinal profile when the profiles are angled in during installation by different lever arms.

Figure 1C:
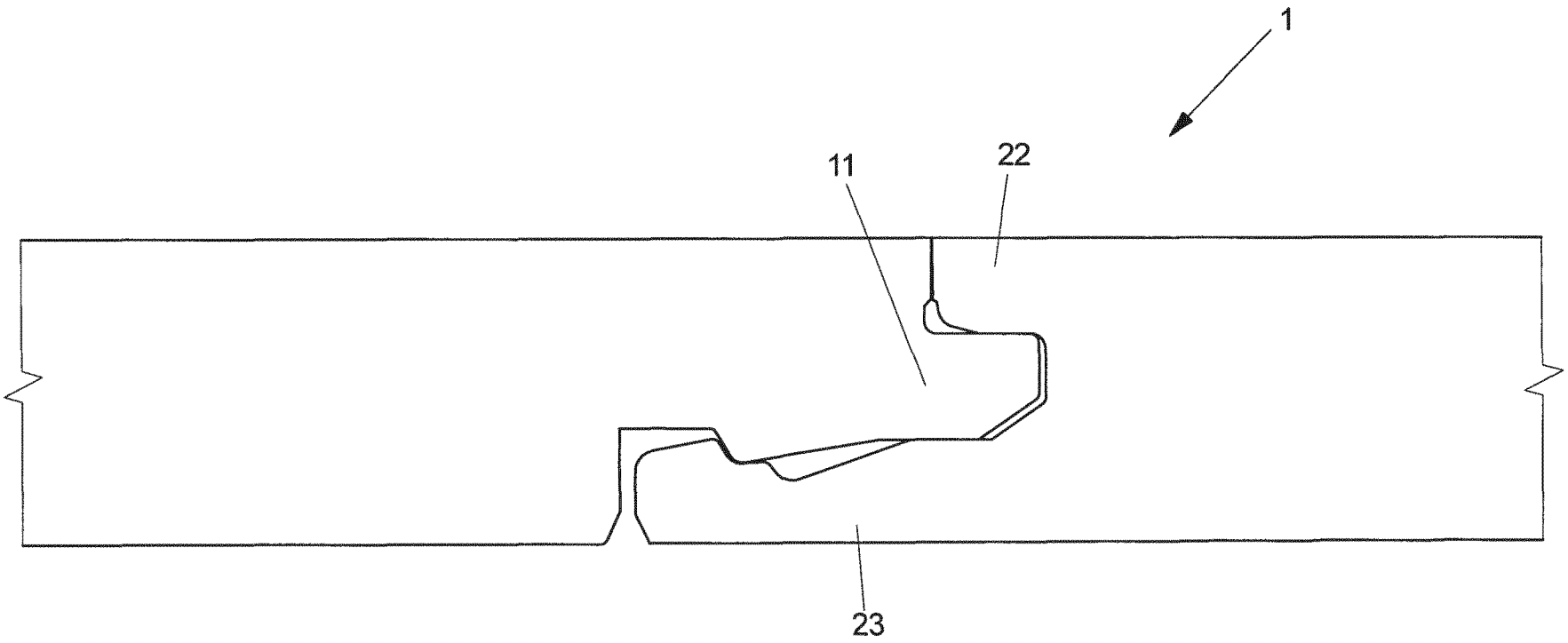
FIG. 1C shows a schematic cross-section of two joined floor panels with the tongue profiling shown in FIG. 1A and the groove profiling shown in FIG. 1B.

In the coupled state of the floor panels shown in FIG. 1C, a gap can also be seen at the transition to the panel underside between the lower lip 23 and lower tongue edge, which occurs in particular in the case of the installation of HDF panels.

Figure 2C:
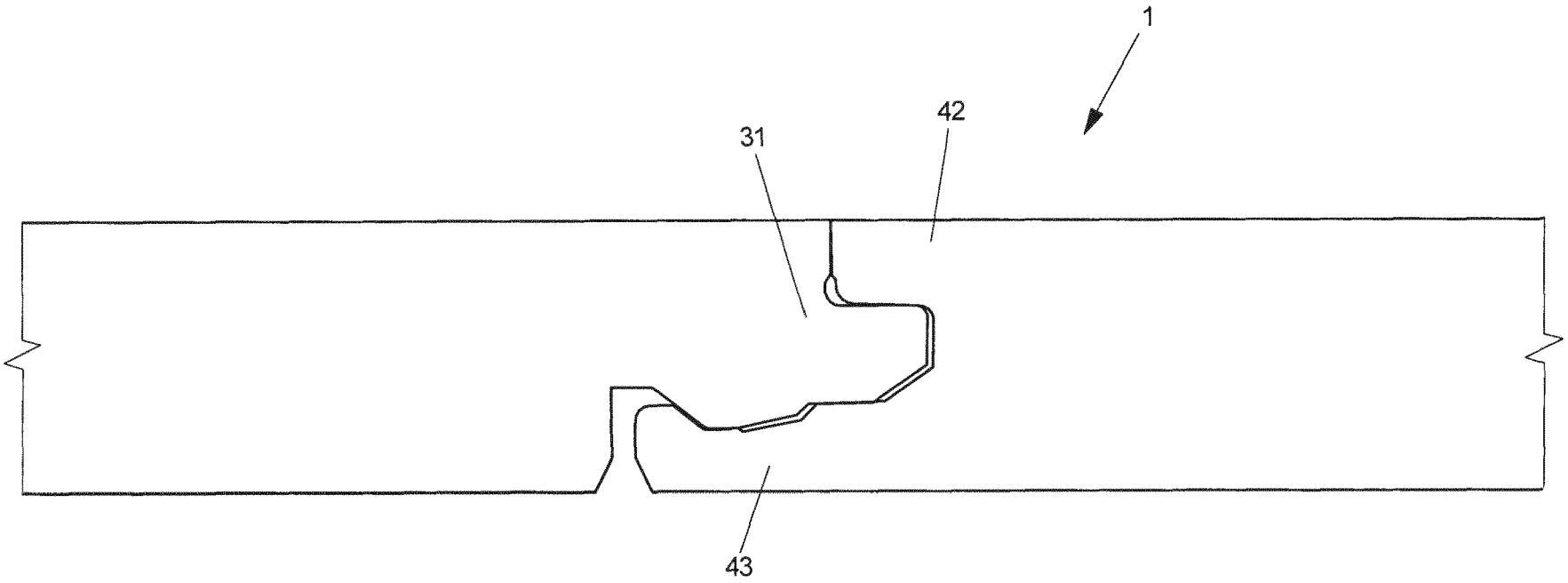
FIG. 2C shows a schematic cross-section of 2 assembled floor panels with the tongue profiling shown in FIG. 2A and the groove profiling shown in FIG. 2B.

The second embodiment of the tongue-and-groove profiling shown in FIGS. 2A to 2C is provided as a longitudinal profile in the longitudinal sides of the floor panel, as mentioned above.

The tongue profile of FIG. 2A is essentially the same as the tongue profile of FIG. 1A, although the length of the lower tongue side 13 in the transverse profile differs from the length of the lower tongue side 33 in the longitudinal profile. In particular, the length of the lower tongue side 13 in the transverse profile is longer than in the longitudinal profile of FIG. 2A.

In addition, the geometry of the projection 14 in the transverse profile differs from the geometry of the projection 34 in the longitudinal profile. The projection 14 in the transverse profile is weaker than the projection 34 in the longitudinal profile, i.e. the 14 in the transverse profile is smaller than the height of the projection 34 in the longitudinal profile. This geometric difference is also due to the different behavior of the transverse profile and the longitudinal profile when the profiles are angled in during installation by different lever arms.

The groove profiling of FIG. 2B differs from the groove profiling of FIG. 1B in particular in the angle of inclination of the beveled joining surface. Thus, the joining surface 26 of FIG. 1B is beveled by 1°, while the joining surface 46 in FIG. 2B has a bevel of 2°. The differences in the chamfer of the joining surfaces of the groove profiling in the transverse profile and in the longitudinal profile are due to the length of the transverse sides and longitudinal sides.

In the joined state (see FIG. 2C), an angle of 3° is formed between the beveled joining surfaces 36, 46. The upper contact points of the joining surfaces are thus also pressed together along the longitudinal edges, forming an almost continuous surface.

Also, the length of the lower lip 23 of the transverse profile differs from the length of the lower lip 43 of the longitudinal profile, with the lower lip 23 of the transverse profile being longer than the lower lip 43 of the longitudinal profile.

Figure 3A:
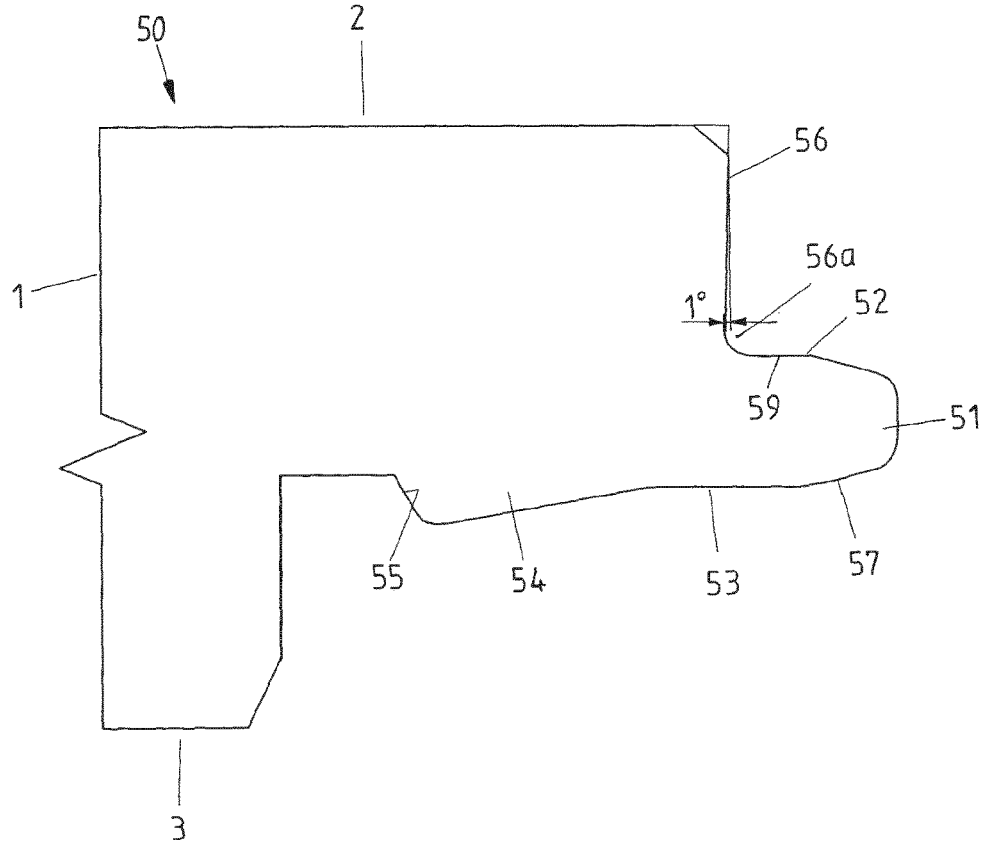
FIG. 3A shows a schematic cross-section of a floor panel with a thickness of 12 mm with a tongue profiling according to a third embodiment (transverse profile)
Figure 3B:
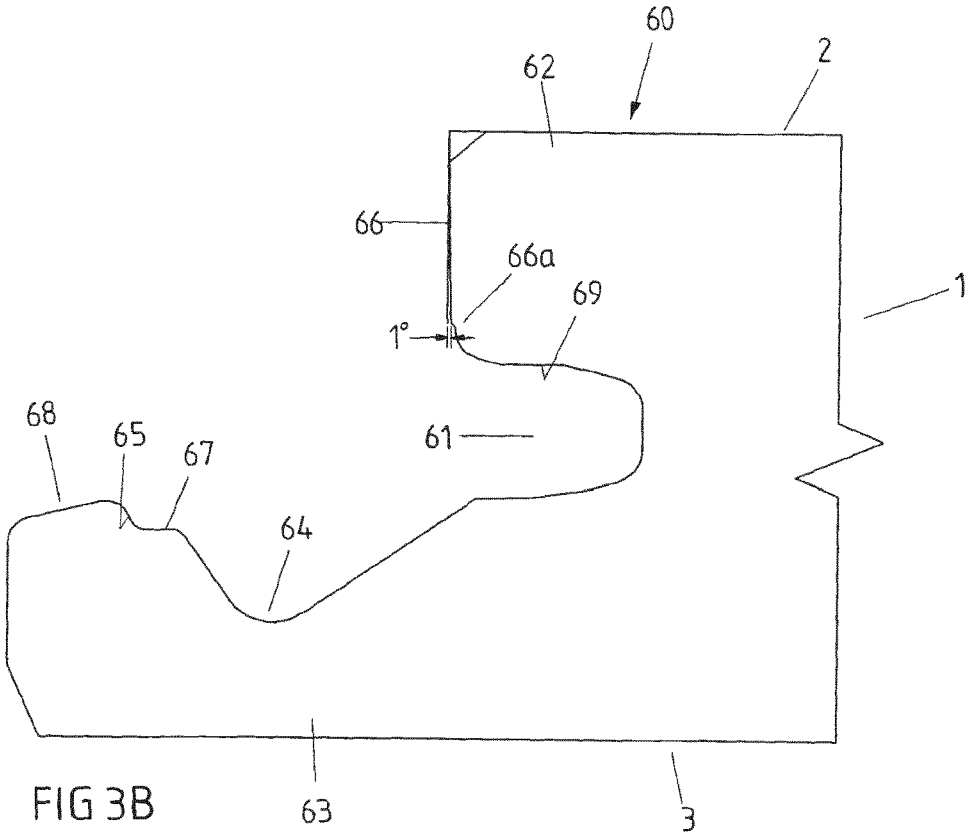
FIG. 3B shows a schematic cross-section of a floor panel with a thickness of 12 mm with a groove profiling according to a third embodiment (transverse profile)

The third embodiment of the tongue-and-groove profiling shown in FIGS. 3A to 3B is provided in the transverse sides of a floor panel with a thickness of 12 mm as a transverse profile.

Figure 4A:
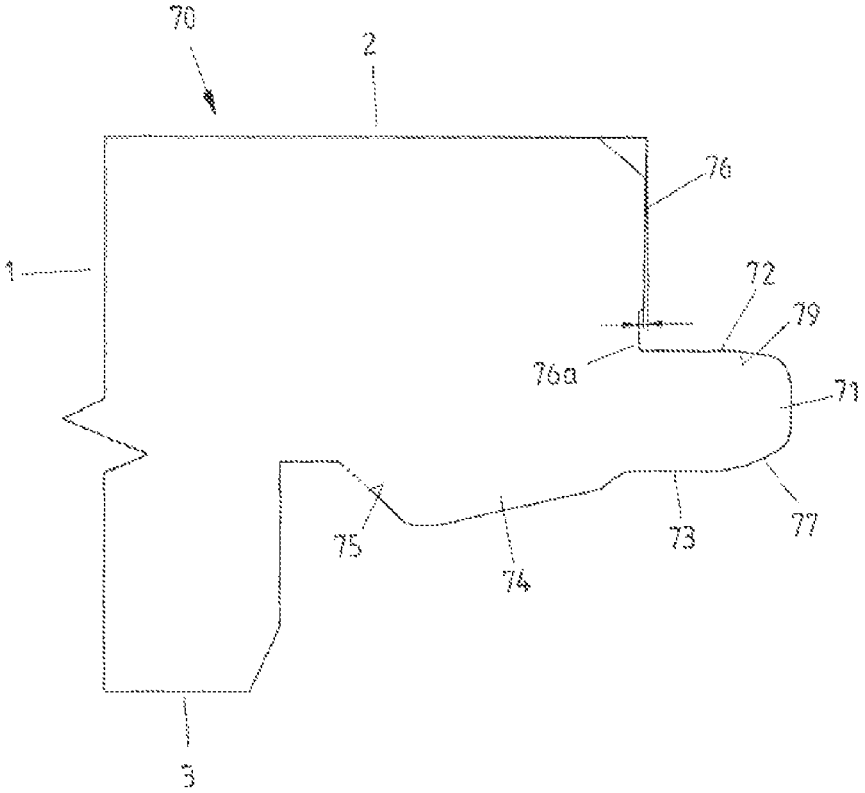
FIG. 4A shows a schematic cross-section of a floor panel with a thickness of 12 mm with a tongue profiling according to a fourth embodiment (longitudinal profile)
Figure 4B:
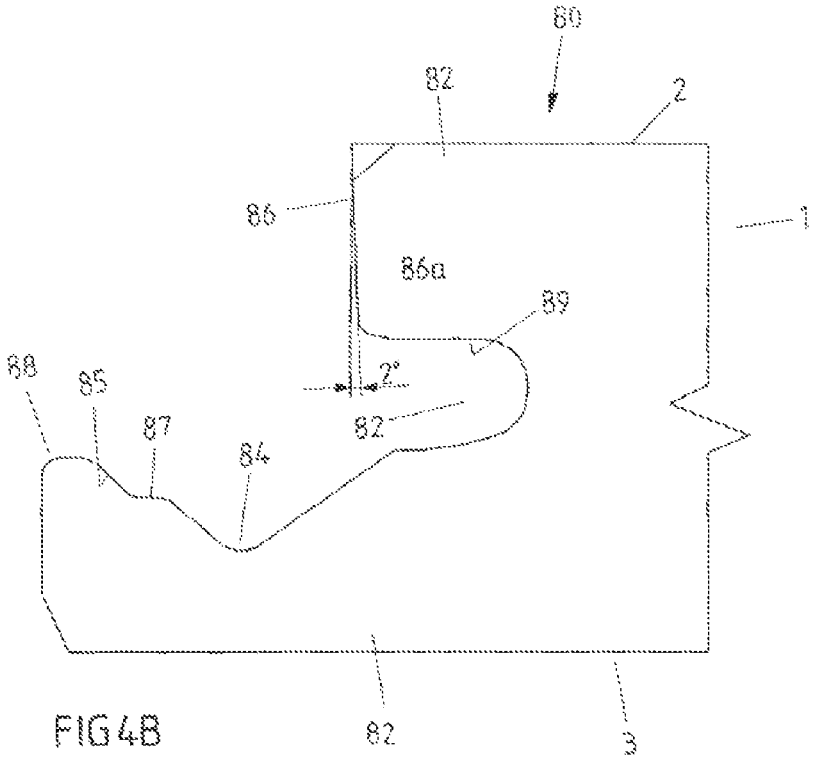
FIG. 4B shows a schematic cross-section of a floor panel with a thickness of 12 mm with a groove profiling according to a fourth embodiment (longitudinal profile).

The fourth embodiment of the tongue -groove profiling shown in FIGS. 4A to 4B is again provided in the long sides of a floor panel with a thickness of 12 mm as a longitudinal profile.

The tongue -groove profiles of FIGS. 3A, 3B and 4A, 4B are substantially the same as the tongue -groove profiles of FIGS. 1A, 1B and 2A, 2B, so reference is made to the above.

LIST OF REFERENCE CHARACTERS

1 Floor panel
2 upper side of the floor panel
3 lower side of the floor panel
10, 30 first side edge of a panel with a thickness of 4.5 mm with tongue profiling
11, 31 tongue
12, 32 upper side of the tongue
13, 33 lower side of the tongue
14, 34 projection
15, 35 Contact surface of the projection 14, 34
16, 36 bevelled joining surface
16*a*, 36*a* Recess in bevelled joining surface 16, 36
17, 37 Chamfer
19, 39 Contact surface on upper side 12, 32
20, 40 second side edge with a thickness of 4.5 mm with groove profiling
21, 41 Groove
22, 42 upper lip
23, 43 lower lip
24, 44 Recess in the lower lip 23,43
25, 45 Recess contact surface 24, 44
26,46 beveled joining surface
26*a*, 46*a* chamfer
27, 47 Saddle in the recess 24, 44
28, 48 Ramp area
29,49 Contact area at the bottom of the upper lip 22.42
50, 70 first side edge of a panel with a thickness of 12 mm with tongue profiling
51, 71 tongue
52, 72 upper side of the tongue
53, 73 lower side of the tongue
54, 74 projection
55, 75 Contact surface of projection 54, 74
56, 76 bevelled joining surface
56*a*, 76*a* Recess in joining surface 56, 76
57, 77 Chamfer
59, 79 Contact surface on upper side 52, 72
60, 80 second side edge with a thickness of 12 mm with groove profiling
61, 81 Groove
62, 82 upper lip
63, 83 lower lip
64, 84 Recess in lower lip 63,83
65, 85 Contact surface of recess 64, 84
66, 86 bevelled joining surface
66*a*, 86*a* chamfer
67, 87 Saddle in the recess 64, 84
68, 88 Ramp area
69,89 Contact area on the underside of the upper lip 62.82

The invention claimed is:

1. A hard floor panel with a core made of a wood-based material board, a wood-based material-plastic board or a plastic board with an upper side and a bottom side and with a first side edge and a second side edge for floating installation forming a flooring panel network, wherein the side edges opposing one another are provided with tongue and groove profiles, wherein a tongue and a joining surface are provided in a first lateral edge and a groove and a joining surface are provided in a second lateral edge opposite to the first lateral edge, wherein the tongue of the first side edge has an upper side and a lower side;

wherein a projection with a contact surface is provided on the lower side of the tongue;

wherein the joining surface of the first side edge extends from the upper side of the floor panel to the upper tongue side, and the joining surface is beveled;

wherein the joining surface of the first side edge is inclined away from the upper side of the floor panel inwardly away from the tongue, wherein the groove in the second side edge has an upper side and a bottom side, wherein the upper side of the groove is defined by an upper lip and the lower side of the groove is defined by a lower lip;

wherein a recess with a contact surface is provided in the lower lip of the groove;

wherein the joining surface of the second side edge extends from the upper side of the floor panel along the upper lip and the joining surface is beveled;

wherein the joining surface of the second side edge is inclined away from the upper side of the floor panel inwardly towards the groove, wherein, in an assembled state of the hard floor panel with an adjacent hard floor panel, the projection of the tongue engages in the recess of the lower lip of the groove so that the contact surfaces of the projection of the tongue and the recess of the lower lip of the groove exert a tensioning force on each other; and wherein, when the beveled joining surface of the first side edge of a tongue profiling and the beveled joining surface of the second side edge of a groove profiling are in contact in a joined state of at least two floor panels, a line pressure occurs along the beveled joining surfaces of the side edges of the tongue profiling and the groove profiling at contact points.

2. The floor panel according to claim 1, wherein the bevel of the joint surface of the first lateral edge from the upper side of the floor panel to an upper spring side is between 1 and 5°.

3. The floor panel according to claim 1, wherein the bevel of the joint surface of the second lateral edge of the groove profiling from the upper side of the floor panel along the upper lip of the groove is between 1 and 5°.

4. The floor panel according to claim 1, wherein the bevel of the joint surfaces of the tongue profiling and the groove profiling each has the same angles.

5. The floor panel according to claim 1, wherein the bevel of the joint surfaces of the tongue profiling and the groove profiling have different angles in each case.

6. The floor panel according to claim 1, wherein a thickness of the tongue corresponds to the width of the groove.

7. The floor panel according to claim 1, wherein the recess is provided in the lower lip of the groove in the portion located in the part of the lower lip of the groove extending beyond the upper lip of the groove.

8. The floor panel according to claim 1, wherein at least one saddle is provided in the recess of the lower lip of the groove.

9. The floor panel according to claim 1, wherein the tongue and groove profiles have one of the following properties or a combination thereof:

roundings at the corners of the tongue and groove profiles;

dust chambers between all sides of the interlocking floor panels;

a ramp surface at the free end of the lower lip of the groove; and contact surfaces formed by the upper side of the spring and the lower side of the upper lip, which are substantially parallel to the plane defined by the floor panels.

10. The floor panel according to claim 1, wherein the tongue and groove profiles enable at least two floor panels to be joined together by obliquely attaching a first floor panel to a horizontally arranged second floor panel followed by pivoting the first floor panel downwards in the direction of the laying planes.

11. The floor panel according to claim 1, comprising a rectangular shape, with tongue and groove profiles on the longitudinal side edges and on the transverse side edges.

12. The floor panel according to claim 11, wherein the tongue and groove profiles in the longitudinal side edges and in the transverse side edges are the same or different from each other.

13. The floor panel according to claim 1, wherein the panels have a core of high-density fiberboard (HDF) or medium-density fiberboard (MDF) board, wood plastic composite (WPC) board, or polyvinyl chloride (PVC) carrier board.

14. A method for floatingly laying floor panels according to claim 1, forming a flooring panel network comprising the following steps:

laying of a first floor panel, joining a second floor panel to the first floor panel, wherein the tongue of the second floor panel is inserted into the groove of the first floor panel, and wherein the lower lip of the groove profiling is bent outwards in the joined state, so that the lower lip provides a force that permanently forces the panels toward each other.

15. A floor panel network obtainable by a method according to claim 14.

* * * * *